US005839505A

United States Patent [19]

Ludwig et al.

[11] Patent Number: 5,839,505

[45] Date of Patent: Nov. 24, 1998

[54] DIMPLED HEAT EXCHANGE TUBE

[75] Inventors: Richard M. Ludwig, Tulsa; Richard J. Davis, Broken Arrow, both of Okla.

[73] Assignee: AAON, Inc., Tulsa, Okla.

[21] Appl. No.: 690,367

[22] Filed: Jul. 26, 1996

[51] Int. Cl.[6] ..... F28F 13/12

[52] U.S. Cl. ..... 165/109.1; 165/177; 165/DIG. 497; 165/146; 138/38

[58] Field of Search ..... 165/109.1, 177, 165/179, 146; 138/38

[56] References Cited

U.S. PATENT DOCUMENTS

| | | | |
|---|---|---|---|
| 910,192 | 1/1909 | Grouvelle et al. . | |
| 1,315,853 | 9/1919 | Nordling et al. . | |
| 2,016,720 | 10/1935 | Krause | 138/38 |
| 2,252,045 | 8/1941 | Spanner | 138/38 |
| 3,481,394 | 12/1969 | Withers, Jr. | 165/179 |
| 4,368,777 | 1/1983 | Grasso | 165/154 |
| 4,585,059 | 4/1986 | Lee | 165/154 |
| 4,690,211 | 9/1987 | Kuwahara et al. | 165/177 |
| 4,715,436 | 12/1987 | Takahashi et al. | 165/177 |
| 5,271,376 | 12/1993 | Lu et al. | 126/110 R |
| 5,375,654 | 12/1994 | Hougland et al. | 165/109.1 |
| 5,573,062 | 11/1996 | Ooba et al. | 165/177 |

*Primary Examiner*—Allen Flanigan
*Attorney, Agent, or Firm*—Molly D. McKay

[57] ABSTRACT

An S-shaped heat exchange tube with improved heat exchange efficiency. The tube is provided with a quartet of entry dimples in a first segment of the tube adjacent an inlet end of the tube, a first series of dimple pairs in a second segment of the tube and a second series of dimple pairs in a third segment of the tube.

The quartet of entry dimples lie in a plane approximately perpendicular to a longitudinal axis of the first segment. At least the first three dimple pairs of the first series are graduated in depth, with the first dimple pair in the first series being provided adjacent to the first segment and having a depth less than a depth of the second dimple pair in the first series. The third dimple pair in the first series and all dimple pairs following the third dimple pair in the first series have depths which are equal. Depths of all dimple pairs in the second series are equal to the depth of the final dimple pair of the first series.

19 Claims, 2 Drawing Sheets

DIMPLED HEAT EXCHANGE TUBE

BACKGROUND OF THE INVENTION

1. Field of the Invention

The present invention relates to an improvement in S-shaped heat exchange tubes. More specifically, the present invention is a series of dimples provided in the wall of a heat exchange tube at strategic locations and in particular arrangements to increase the heat exchange efficiency of the tube.

2. Description of the Related Art

Heat exchange tubes are commonly utilized in commercial heating, ventilation and air conditioning (HVAC) systems. Such applications commonly employ either straight heat exchange tubes, U-shaped heat exchange tubes or S-shaped heat exchange tubes. In such applications, each heat exchange tube attaches on its inlet end to a burner and attaches on its opposite outlet end to a flue for exhausting combustion gases. Hot combustion gases are produced by the burner and enter the inlet end of the tube. The combustion gases travel through the tube, giving up heat to the walls of the tube as they move toward the outlet end. Heat absorbed from the hot combustion gases as they travel within the tube passes through the wall of the tube and is transferred to an air stream flowing external to the tube. The external air stream usually flows parallel to a plane in which the tube resides. The now heated air stream is then circulated out of the HVAC unit via ducts, out the ducts and into and throughout the interior of a building to be heated. Return air is received back from the building's interior into the HVAC unit via return air ducts. The previously described heating process continues during winter months uninterrupted except for the normal cycling of the HVAC unit.

Prior art tubes, such as the prior art S-tube illustrated in FIGS. 1 through 3 of the accompanying drawings, are generally provided with walls of fairly uniform diameter from inlet end to outlet end. This can be seen in the cross-sectional views of FIGS. 2 and 3.

It is a common practice to employ a baffle in the first segment of an S-tube, adjacent the inlet end, in order to cause turbulence in the inflowing hot combustion gases, as shown in FIGS. 1 and 2. If a baffle is not employed in the S-tubes, heat exchange occurring in the first segment of the S-tube is unacceptably low. Even if a baffle is employed in the first segment of the S-tube, thus increasing the heat transfer in this segment, the remaining portions of the S-tube are typically not provided with baffles nor with any other means for increasing heat transfer. Although the S-tube shown in FIGS. 1–3 has its inlet end at the top, it is understood that an S-tube may, alternately, have its inlet end at the bottom.

Another problem with prior art tubes is that as the hot combustion gases move through the tube from the tube's inlet end to its outlet end, the gases cool and are thus significantly reduced in volume, resulting in low velocities and low turbulence toward the outlet end. These low velocities and low turbulence result in less efficient heat transfer, since good heat transfer depends on high gas velocity turbulence.

This problem of low velocity and low turbulence has been addressed in prior art tubes by physical reduction in the tubing diameter adjacent the outlet end or, alternately, by inserting a baffle into the tube adjacent the outlet end. Neither of these solutions are cost effective, since it is expensive to attach together two different sizes of tubes to form a single heat exchange tube, and alternately, it is expensive to add a baffle inside the tube at the outlet end, since any such baffle must be constructed of expensive stainless steel in order to withstand the extreme heat and corrosive conditions experienced inside a heat exchange tube.

The present invention addresses the problem of heat transfer efficiency in tubes by providing a quartet of dimples adjacent the inlet end of the tube. This quartet of inwardly extending dimples creates turbulence in the hot combustion gases as they pass through the first segment of the tube. Thus, one object of the present invention is to increase heat transfer efficiency of the tube in its first segment by means of use of a quartet of dimples provided adjacent the inlet end of the tube.

Another object of the present invention is to increase heat transfer efficiency of the second and third segments of the tube by providing a series of opposing dimples in the second segment and a series of opposing dimples in the third segment.

Still another object of the present invention is to provide a series of dimple pairs of graduated depth along the second segment of the tube in order to increase heat transfer efficiency of the tube without causing the wall of the tube to be heated to the point of failure.

Still a further object of the present invention is to provide a low cost tube capable of more efficiently transferring heat.

SUMMARY OF THE INVENTION

The present invention is a dimpled heat exchange tube exhibiting increased heat exchange efficiency. The tube is hollow from its inlet end, which attaches to a burner, to its outlet end, which attaches to an exhaust flue. The tube is provided with an first segment adjacent the inlet end, a second segment adjacent the first segment, and a third segment located between the second segment and the outlet end.

The tube is provided with a quartet of entry dimples in a wall of the tube adjacent the inlet end. The quartet of entry dimples lies in a plane approximately perpendicular to a longitudinal axis of the first segment. The quartet is comprised of two pairs of opposing and inwardly extending entry dimples, with each pair approximately perpendicular to the other pair. Each entry dimple has a depth equal to the depth of the other entry dimples, and the depths of the entry dimples are small enough that the wall of the tube does not touch internally at the opposing dimples.

The tube is provided with a first series of dimple pairs along the second segment and a second series of dimple pairs along the third segment.

At least the first, second and third dimple pairs in the first series have depths which are graduated. The first dimple pair, which is adjacent to the first segment, has a depth less than the depths of all other dimple pairs in the first and second series of dimple pairs. The third dimple pair in the first series has a depth equal to the depths of all of the dimple pairs in the first series following the third dimple pair and equal to the depths of all of the dimple pairs in the second series.

DETAILED DESCRIPTION OF THE PREFERRED EMBODIMENT

Figure 1:
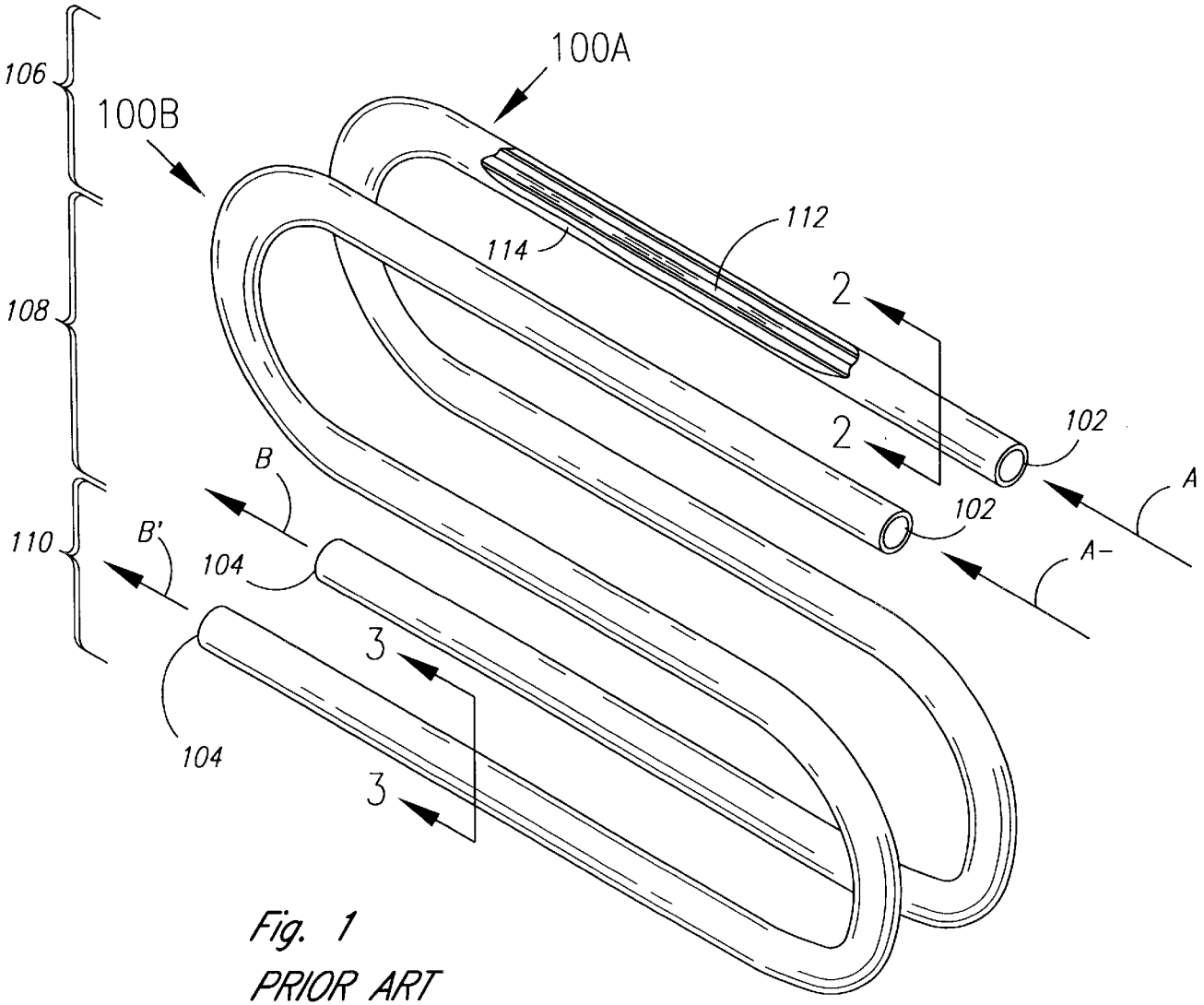
Fig. 1 PRIOR ART
FIG. 1 is a partially cut away perspective view of a prior art S-shaped tube.

Referring now to the drawings and initially to FIG. 1, there is illustrated two prior art S-shaped heat exchange tubes, designated in the drawings by numerals 100A and 100B. Hereinafter, the terms "S-shaped heat exchange tube", "S-shaped tube", "S-tube", and "tube" will be used synonymously. Also, although the invention is described in respect to an S-shaped heat exchange tube, the invention is not so limited, and the invention is understood to apply to any shape or type of heat exchange tube. The two prior art tubes 100A and 100B are identical to each other and are shown side by side in FIG. 1 as they would be positioned when installed in a heating, ventilation and air conditioning (HVAC) unit. Each of the prior art tubes 100A and 100B is provided with an inlet end 102 and an opposite outlet end 104. Each tube 100A and 100B is hollow throughout its entire length. A burner (not shown) is secured to an inlet end 102 of each of the tubes 100A and 100B. Hot combustion gases, originating from the burners (not shown), enter at the inlet end 102 of the tube 100A or 100B and move consecutively through a first segment 106, a second segment 108, and a third segment 110 of the tube, either 100A or 100B, before exiting the tube, either 100A or 100B, via the outlet end 104, as shown by arrows B and B'.

Figure 2:
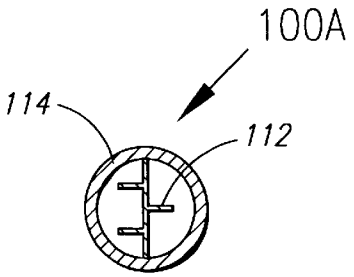
FIG. 2 is a cross-sectional view taken along line 2—2 of FIG. 1.
Figure 3:
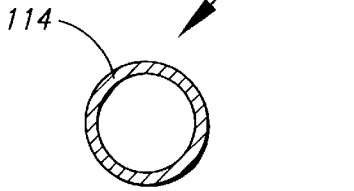
FIG. 3 is a cross-sectional view taken along line 3—3 of FIG. 1.

As illustrated in FIGS. 1 and 2, a baffle 112 is typically placed within a wall 114 of the prior art tube 100A or 100B, in the first segment 106 in order to produce turbulence in the combustion gases as they pass through the first segment 106. The second segment 108 is normally not provided with any baffles nor with any other means for producing turbulence in the combustion gases as they pass therethrough. Although not illustrated, a baffle may also be employed in the third segment 110 to increase turbulence and to increase velocity of the combustion gases as they pass through the third segment 110. The walls 114 of the prior art tubes 100A or 100B are of uniform diameter, as can be seen by FIGS. 2 and 3, from their inlet end 102 to their outlet end 104. However, other prior art tubes (not illustrated) employ smaller diameter tube adjacent the outlet end 104 in order to increase turbulence and velocity of flow therethrough.

Referring now to FIGS. 4 through 9, there is illustrated a dimpled heat exchange tube 10 constructed in accordance with a preferred embodiment of the present invention. The tube 10 is provided with an inlet end 12 and an opposite outlet end 14. The tube 10 is hollow therethrough such that hot combustion gases, indicated by arrow A in FIG. 4, enter the inlet end 12 and then pass consecutively through a first segment 16 of the tube 10, a second segment 18 of the tube 10, and a third segment 20 of the tube 10, before exiting the tube 10 at the outlet end 14, as indicated by arrow B in FIG. 4.

Figures 4, 5, 6, 7, 8, 9:
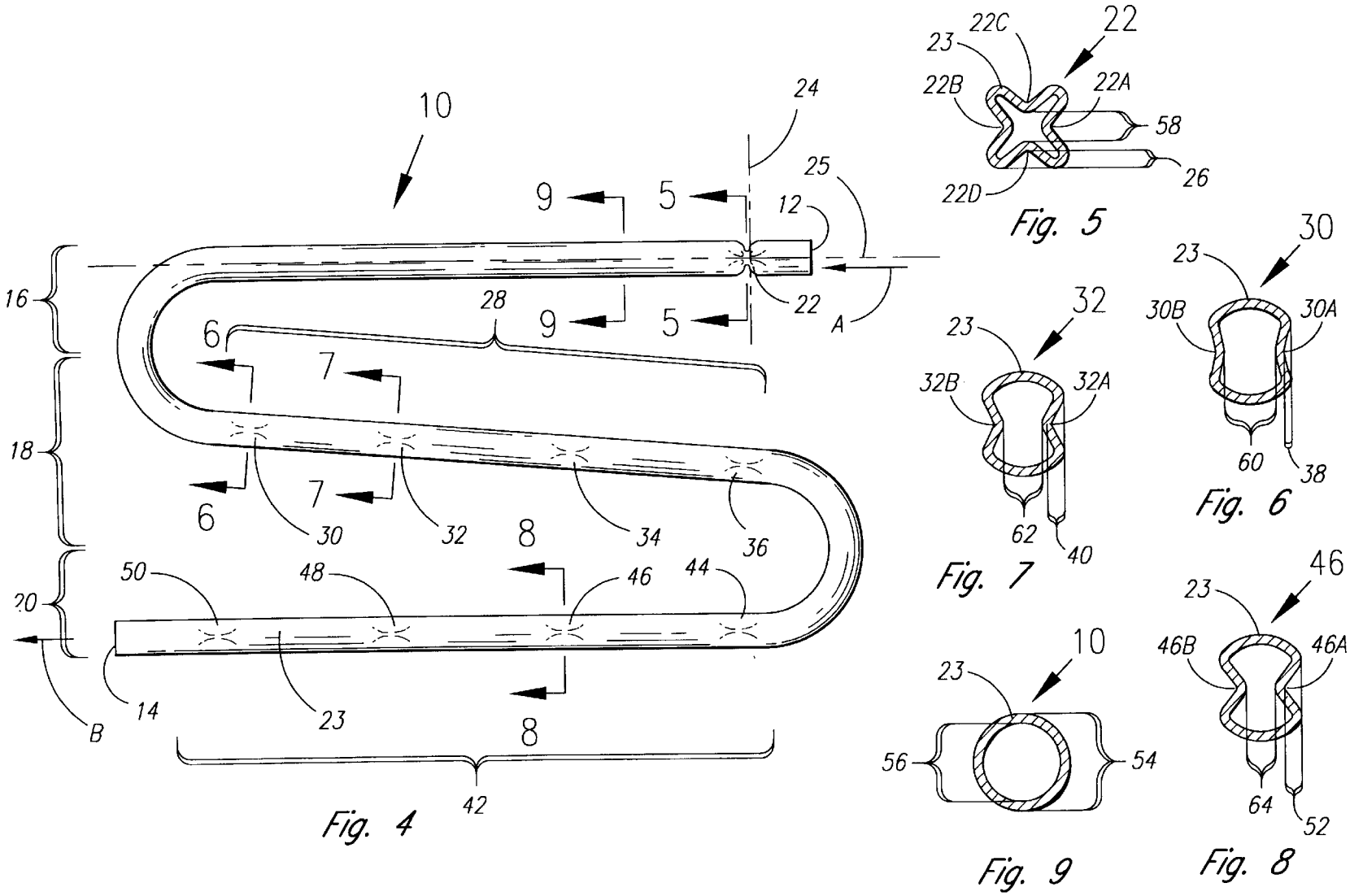
FIG. 4 is a right side view of an S-shaped tube constructed in accordance with a preferred embodiment of the present invention.
FIG. 5 is a cross-sectional view taken along line 5—5 of FIG. 4.
FIG. 6 is a cross-sectional view taken along line 6—6 of FIG. 4.
FIG. 7 is a cross-sectional view taken along line 7—7 of FIG. 4.
FIG. 8 is a cross-sectional view taken along line 8—8 of FIG. 4.
FIG. 9 is a cross-sectional view taken along line 9—9 of FIG. 4.

As illustrated in FIGS. 4 and 5, the tube 10 does not employ a baffle. Instead, a quartet of entry dimples 22 are provided in a wall 23 of the tube 10 so that the quartet of entry dimples 22 are adjacent the inlet end 12. The quartet of entry dimples 22 consist of two pairs of opposing and inwardly extending entry dimples, with entry dimples 22A and 22B comprising the first pair and entry dimples 22C and 22D comprising the second pair. Both pairs of entry dimples (22A and 22B) and (22C and 22D) lie in a plane 24 perpendicular to a longitudinal axis 25 of the first segment 16. FIG. 5 is a cross-sectional view of the tube 10 taken along plane 24. As shown in FIG. 5, the two pairs of entry dimples (22A and 22B) and (22C and 22D) are approximately perpendicular to each other, so that the first pair of opposing entry dimples 22A and 22B is located at 3 o'clock and 9 o'clock and the other pair of opposing entry dimples 22C and 22D is located at 12 o'clock and 6 o'clock.

Each of the four individual entry dimples 22A, 22B, 22C and 22D, comprising the quartet, has a depth 26 so that all entry dimples 22A, 22B, 22C, and 22D are of equal to the depth, and the depths 26 are not so large as to cause the wall 28 of the tube 10 to touch itself at the opposing entry dimples 22, thereby obstructing the tube 10. Optimum distance between opposite sides of the wall 23 at the entry dimples 22 will vary with size of the tube 10, but for example, for a 2.0 inch outside diameter (or simply OD) tube 10, a distance of 0.75 inches inside diameter (or simply ID) is acceptable between opposing pairs of entry dimples (22A and 22B) and (22C and 22D). This quartet of entry dimples 22 causes hot combustion gases entering the inlet end 112 of the tube 10, at arrow "A", to undergo sufficient turbulence as the gases pass through the first segment 16 of the tube 10 to overcome a natural tendency of the gases to form an internal insulating layer of air adjacent the wall 23 in the first segment 16, and thus, increase heat exchange efficiency of the tube 10 in the first segment 16.

The second segment 18 of the tube 10 is provided with a first series 28 of opposing and inwardly extending dimple pairs 30, 32, 34 and 36. Although the first series 28 is described herein as containing only four dimple pairs, i.e., 30, 32, 34, and 36, it is to be understood that the invention is not so limited and dimple pairs, in addition to those described and illustrated, may be included in the first series 28.

At least the first, second and third dimple pairs, 30, 32 and 34, are of graduated depths. This is illustrated in FIGS. 6 and 7 for the first and second dimple pairs 30 and 32. The first dimple pair 30 is comprised of two opposing and inwardly extending dimples 30A and 30B, each of which is of a depth 38. The second dimple pair 32 is also comprised of two opposing dimples 32A and 32B, each of which is of a depth 40. The depth 38 of the first dimple pair 30 in the first series 28 is less than the depth 40 of the second dimple pair 32 of the first series. Likewise, the depth 40 of the second dimple pair 32 of the first series 28 is less than a depth (not illustrated) of the third dimple pair 34 of the first series 28. Each remaining dimple pair, following the third dimple pair 34, up through and including the last dimple pair in the first series 28, has a depth (not illustrated) equal to the depth (not illustrated) of the third dimple pair 34.

The third segment 20 of the tube 10 is provided with a second series 42 of opposing and inwardly extending dimple pairs 44, 46, 48, and 50. Although the second series 42 is described herein as containing only four dimple pairs, i.e., 44, 46, 48 and 50, it is to be understood that the invention is not so limited and dimple pairs, in addition to those described and illustrated, may be included in the second series 42.

Each of the dimple pairs 44, 46, 48 and 50 of the second series 42 is comprised of two opposing and inwardly extending dimples, each of which is of a depth 52, as illustrated in FIG. 8 for two opposing and inwardly extending dimples 46A and 46B comprising dimple pair 46.

Preferably, the third dimple pair 34 of the first series 28 and all remaining dimpled pairs following the third dimple pair 34, up through and including the last dimple pair 36 of the first series 28, also have depths equal to depth 52.

Instead of describing the depths, i.e., 26, 38, 40 and 52, of entry dimples 22 and dimple pairs 30, 32, 34, 36, 44, 46, 48 and 50, as measured by the inward deflection of the wall 23 measured external to the tube 10, this same concept could be described based on distance between the tube's wall 23 measured internally within the tube 10 at opposing dimple pairs, or what is more commonly known as inside diameter or simply ID. For example, the tube 10 with an initial outside diameter 54, as illustrated in FIG. 9, of 2.0 inches, and an initial inside diameter 56, as also illustrated in FIG. 9, of 1.87 inches, would have a preferred inside diameter 58 for the entry dimples 22 of 0.75 inches, a preferred inside diameter 60 of the first dimple pair 30 in the first series 20 of 0.50 inches, a preferred inside diameter 62 of the second dimple pair 32 in the first series 20 of 0.375 inches, and a preferred inside diameter 64 of all other dimpled pairs, i.e., 34, 36, of the first series 28 and of all dimpled pairs, i.e., 44, 46, 48 and 50, of the second series 42 of 0.25 inches.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A heat exchange tube comprising:

an S-shaped tube provided with an inlet end and an opposite outlet end, two pairs of opposing and inwardly extending entry dimples being provided in a wall of said tube adjacent said inlet end, said two pairs of opposing and inwardly extending entry dimples being provided approximately perpendicular to each other in a single plane and said plane being approximately perpendicular to a longitudinal axis of a first segment of the tube, a first series of opposing and inwardly extending dimple pairs being provided in the wall of said tube along a second segment of said tube, a first series of opposing and inwardly extending dimple pairs being provided in a wall of said tube along a second segment of said tube, said first series of opposing and inwardly extending dimple pairs being graduated in depth so that a first dimple pair of the first series which is located adjacent to said first segment of the tube has a smaller depth than a depth of a last dimple pair of the first series which is located adjacent to a third segment of said tube.

2. A tube according to claim 1 wherein only first, second and third dimple pairs of the first series are graduated in depth, and all remaining dimple pairs of the first series have a depth equal to a depth of the third dimple pair of the first series.

3. A tube according to claim 2 further comprising a second series of opposing and inwardly extending dimple pairs being provided in the wall of said tube along said third segment of said tube.

4. A tube according to claim 3 wherein depths of all dimple pairs of said second series are equal to each other.

5. A tube according to claim 4 wherein the depth of each said dimple pair in said second series is the same as a depth of a last dimple pair in the first series.

6. A heat exchange tube comprising an S-shaped tube provided with an inlet end and an opposite outlet end, a first segment of said tube provided adjacent said inlet end, a first series of opposing and inwardly extending dimple pairs being provided in the wall of said tube along a second segment of said tube, said first series of opposing and inwardly extending dimple pairs being graduated in depth so that a first dimple pair of the first series which is located adjacent to said first segment of the tube has a smaller depth than a depth of a last dimple pair of the first series which is located adjacent to a third segment of said tube.

7. A tube according to claim 6 wherein only first, second and third dimple pairs of the first series are graduated in depth, and all remaining dimple pairs of the first series have a depth equal to a depth of the third dimple pair of the first series.

8. A tube according to claim 7 further comprising a second series of opposing and inwardly extending dimple pairs being provided in the wall of said tube along said third segment of said tube.

9. A tube according to claim 8 wherein depths of all dimple pairs of said second series are equal to each other.

10. A tube according to claim 9 wherein the depth of each said dimple pair in said second series is the same as a depth of a last dimple pair in the first series.

11. A tube according to claim 10 further comprising opposing and inwardly extending entry dimples being provided in the wall of said tube adjacent said inlet end.

12. A tube according to claim 11 wherein said opposing and inwardly extending entry dimples comprise two pairs of opposing and inwardly extending entry dimples.

13. A tube according to claim 12 wherein said two pairs of opposing and inwardly extending entry dimples lie in a single plane, and said plane is approximately perpendicular to a longitudinal axis of said first segment of the tube.

14. A tube according to claim 13 wherein the two pairs of opposing and inwardly extending entry dimples are approximately perpendicular to each other.

15. A heat exchange tube comprising a tube provided with an inlet end and an opposite outlet end, a first segment of said tube provided adjacent said inlet end, two pair of opposing and inwardly extending entry dimples being provided in a wall of said tube adjacent said inlet end, said two pairs of opposing and inwardly extending entry dimples being provided approximately perpendicular to each other in a single plane and said plane being approximately perpendicular to a longitudinal axis of a first segment of the tube, a first series of opposing and inwardly extending dimple pairs being provided in the wall of said tube along a second segment of said tube, said first series of opposing and inwardly extending dimple pairs being graduated in depth so that a first dimple pair of the first series which is located adjacent to said first segment of the tube has a smaller depth than a depth of a last dimple pair of the first series which is located adjacent to a third segment of said tube.

16. A tube according to claim 15 wherein only first, second and third dimple pairs of the first series are graduated in depth, and all remaining dimple pairs of the first series have a depth equal to a depth of the third dimple pair of the first series.

17. A tube according to claim 16 further comprising a second series of opposing and inwardly extending dimple pairs being provided in the wall of said tube along said third segment of said tube.

18. A tube according to claim 17 wherein depths of all dimple pairs of said second series are equal to each other.

19. A tube according to claim 18 wherein the depth of each said dimple pair in said second series is the same as a depth of a last dimple pair in the first series.

* * * * *